United States Patent [19]

Jeandaud

[11] Patent Number: 4,848,593

[45] Date of Patent: Jul. 18, 1989

[54] GRANULE DISPENSING APPARATUS, PARTICULARLY DESIGNED FOR A TUBE OF HOMOEPATHIC DRUGS, AND METHOD FOR THE UTILIZATION THEREOF

[76] Inventor: Jean-Claude Jeandaud, Les Asphodeles 35, L'Isle D'Abeau, France

[21] Appl. No.: 943,267

[22] PCT Filed: Mar. 24, 1986

[86] PCT No.: PCT/FR86/00101

§ 371 Date: Jan. 27, 1987

§ 102(e) Date: Jan. 27, 1987

[87] PCT Pub. No.: WO86/05465

PCT Pub. Date: Sep. 25, 1986

[30] Foreign Application Priority Data

Mar. 22, 1985 [FR] France ..... 85 04875

[51] Int. Cl.[4] ..... B65H 3/00

[52] U.S. Cl. ..... 221/207; 221/246; 221/251; 221/256; 221/264; 221/271; 221/272; 221/276

[58] Field of Search ..... 221/196, 206, 207, 246, 221/251, 256, 264, 271, 272, 273, 276, 263; 222/448, 449, 453, 452; 206/535, 536, 540

[56] References Cited

U.S. PATENT DOCUMENTS

| | | | |
|---|---|---|---|
| 2,683,554 | 6/1954 | Mulhauser, Jr. | 221/264 X |
| 2,886,209 | 5/1959 | Lermer | 222/452 X |
| 3,095,085 | 6/1963 | Meijer | 206/536 |
| 3,243,081 | 3/1966 | Schmank . | |
| 3,601,250 | 8/1971 | Merila | 221/246 X |
| 3,854,626 | 12/1974 | Krechmar | 221/264 |
| 3,889,847 | 6/1975 | Uroshevich et al. | 221/276 X |
| 4,230,236 | 10/1980 | Boulter | 221/264 X |
| 4,354,619 | 10/1982 | Wippermann et al. | 206/540 X |
| 4,648,529 | 3/1987 | Blakemore et al. | 221/276 X |
| 4,653,668 | 3/1987 | Gibilisco et al. | 221/263 X |

FOREIGN PATENT DOCUMENTS

| | | | |
|---|---|---|---|
| 2225021 | 4/1973 | France . | |
| 2396697 | 3/1979 | France | 206/536 |

*Primary Examiner*—Joseph J. Rolla
*Assistant Examiner*—S. Parker
*Attorney, Agent, or Firm*—Remy J. VanOphem

[57] ABSTRACT

Dispenser for pills or sweets contained in a tube closed by a lid. When not in use, a chimney prevents the pills from falling out of a hopper disposed within the body of the tube. When the lid is pushed in, a boss displaces the chimney towards the axial center of the tube. The pills are dispensed downwardly therein until they contact a cross-pin which acts as a fixed stop. Releasing the lid causes the chimney and the pills contained therein to move laterally such that the pills then fall to the bottom of the lid.

11 Claims, 4 Drawing Sheets

Fig 11
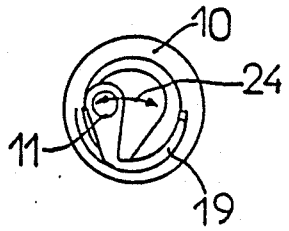
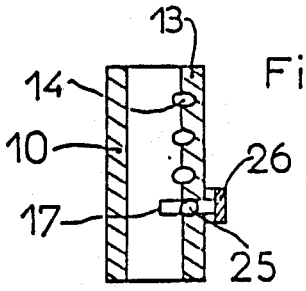
Fig 13
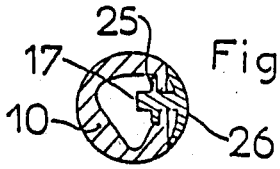
Fig 14
Fig 15
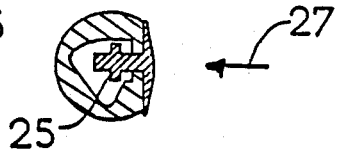

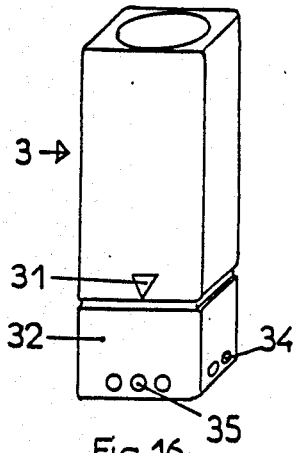
Fig. 16
Fig. 17
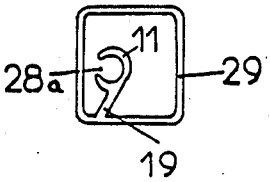
Fig. 19
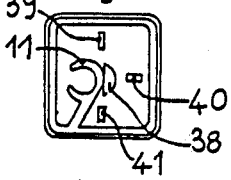
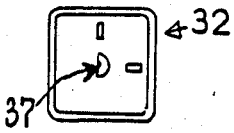
Fig. 18
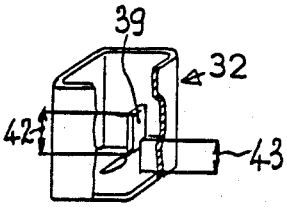
Fig. 20
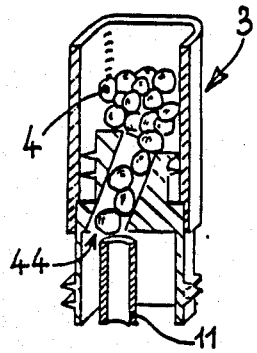
Fig. 21
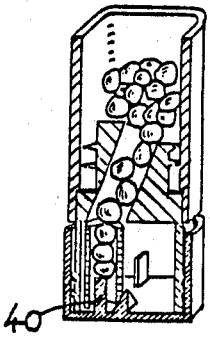
Fig. 22
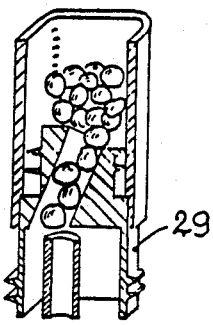
Fig. 23
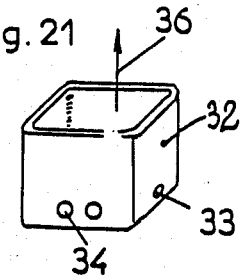
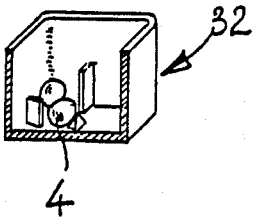

GRANULE DISPENSING APPARATUS, PARTICULARLY DESIGNED FOR A TUBE OF HOMOEPATHIC DRUGS, AND METHOD FOR THE UTILIZATION THEREOF

BACKGROUND OF THE INVENTION

The present invention pertains to a dispensing apparatus designed to equip a tube or box containing pills, sweets or similar granulated products. It applies particularly, although not exclusively, to drugs containing tubes, particularly homeopathic drugs.

Traditionally, homeopathic products are generally found in the shape of spherical pills called "granules" whose diameter varies from 4 to 5 millimeters, or "globules" whose diameter is approximately 1.5 millimeters. These spherical pills are contained in a cylindrical tube. Upon each use, the operator opens the tube and takes a given number of pills therefrom. Thsi operation is particularly delicate in the case of homeopathic drugs since the unused pills must remain in the tube without coming into contact with the hands of the operator to avoid contamination.

Experience shows that by tilting the tube, the operator drops an excessive number of pills which must be put back in the tube, thus, contaminating them.

The present invention is designed to eliminate these disadvantages by offering a simple and economical device, capable of precisely delivering the desired number of pills, granules or globules. It also pertains to the method of utilization of this dispenser.

SUMMARY OF THE INVENTION

A dispenser, such as the one described in the invention, is designed to be recessed in the mouth of a tubular container for containing pills or similar products that are approximately spherical, and is characterized by the fact that it includes a fixed rear opening in front of which an axial tubular chimney moves laterally with reference to a fixed lateral stop which is used to retain the pills that are gravity fed into the chimney when the latter is aligned with the opening. The stop then clears the chimney when the latter is laterally reset in position and is no longer in alignment with the opening.

According to another feature of the invention, a number of means are provided inside the lid of the tube to make the chimney travel laterally, away from its reset position.

According to yet another feature of the invention, such actuation means include a roughly tapered boss extending inwardly at the center of the bottom of the lid, while the rear opening is centered on the geometrical axis of the tube and while in reset position, the chimney is laterally offcentered in the tube, its internal channel pointing to the tip of the lid tapered boss.

According to a still further feature of the invention, the internal diameter of the chimney is approximately equal to the diameter of the pills to be dispensed, while the distance between the rear of the chimney and the fixed stop is equal to a multiple of that diameter.

According to yet another feature of the invention, a number of means are provided to axially set the position of the lateral stop, which allows for the selection of the number of pills to be dispensed.

According to another feature of the invention, a number of return means including an elastic soft blade equip the chimney to bring it back to its reset position when it is no longer activated from the boss of the lid.

BRIEF DESCRIPTION OF THE DRAWINGS

The attached drawings will permit a better understanding of the features of the invention when taken in conjunction with the detailed description thereof.

FIGS. 10 and 11 are cross sections and plane views;

FIGS. 12 through 15 illustrate an alternate embodiment of the ring used to set the position of the fixed stop; and FIGS. 16 through 23 illustrate an alternate embodiment of the device of the present invention.

DETAILED DESCRIPTION OF THE PREFERRED EMBODIMENT

Figure 1:
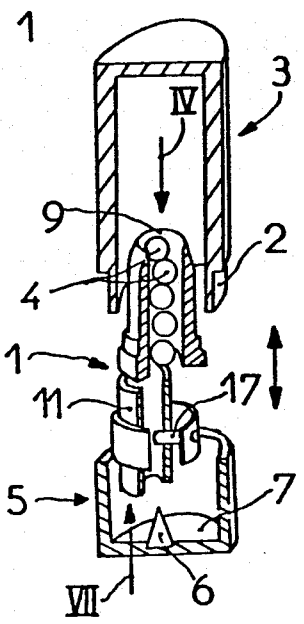
FIG. 1 is an exploded axial sectional view illustrating a dispenser as described in the invention disposed in a traditional pill tube.

A dispenser 1 described in the invention is designed to fit in a mouth 2 of a tube or tubular container 3 containing homeopathic pills for instance. The assembly is sealed by a lid 5 of the tube. The lid 5 includes a boss 6 which is generally tapered and extends inwardly at the center of the bottom 7 of the lid 5.

The dispenser 1 has a body 8 which defines a rear hopper 9 wherein, as the dispenser is turned upside down, the pills 4 contained in the tube 3 fall. A cylindrical skirt 10 is provided at the end of the body 8 but has been omitted from FIGS. 1 through 3 for clarity.

Inside the skirt 10 an axial cylindrical chimney 11, capable of moving laterally under a discharge opening 12 of the hopper 9, has been provided.

Desirably, the chimney 11 is cut laterally in the same general direction, so as to define an axial slot 13 which includes cross notches 14 that are regularly spaced. The distance 15 between two consecutive notches 14 is approximately equal to a diameter 16 of each pill 4.

Figure 2:
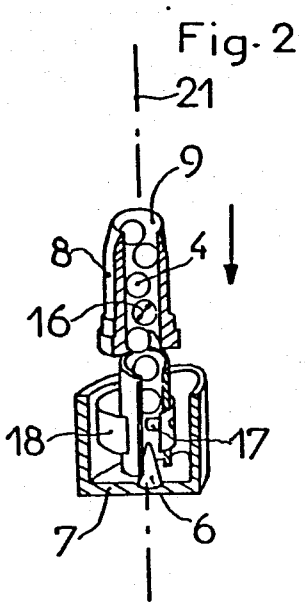
FIGS. 2 and 3 are views similar to FIG. 1 showing the operating sequence of the device thereof.
Figure 5:
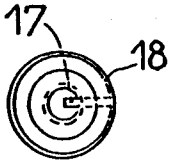
Figure 6:
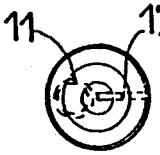
Figure 7:
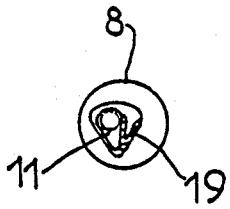
FIG. 7 is a view in the direction of arrow VII of FIG. 1.
Figure 8:
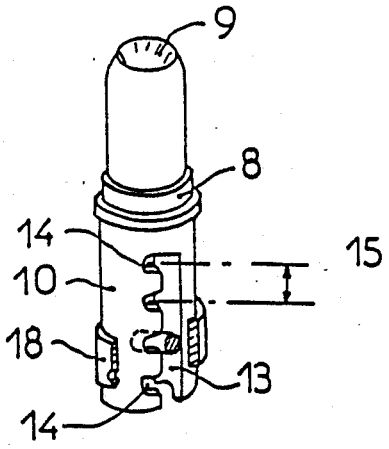
FIG. 8 illustrates the operation of the ring used to set the position of the fixed stop to select the number of pills to be dispensed.

A cross-pin 17 acting as an adjustable fixed stop passes through the slot 13 or one of the notches 14 to extend inside the chimney 11 when the latter is in active position, as shown in FIGS. 2 and 5, in alignment with the discharge opening 12.

The back of the cross-pin 17 is rigidly mounted with an external ring 18 sliding around the cylindrical skirt 10.

The internal diameter of the chimney 11 is approximately equal, notwithstanding the gaps, to the diameter 16 of the pills 4. The chimney 11 is equipped with an elastic return blade 19 which rests against the inside of the skirt 10 to return the chimney 11 to its reset position where it clears laterally with its wall plugging the section of the discharge opening 12 as illustrated in FIGS. 1 and 4, preventing further discharge of the pills 4 into the chimney 11.

Operation of the device is as follows.

The user holds the tube 3 which contains the pills 4. The dispenser 1, topped by the lid 5, is inserted into the mouth 2 of the tube 3. The assembly may then be stored or carried. In this case it should be noted that the lid 5 is not fully pushed over the outside of the mouth 2, so that when pushed back following the direction of arrow VII of FIG. 1, it is still possible to make the lid slide along the tube 3. Furthermore, a clearance 20 remains between the bottom 7 of the lid 5 and the front of the skirt 10.

Figure 4:
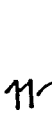
FIGS. 4, 5, and 6 are schematic drawings respectively applying to FIGS. 1, 2 and 3, taken in the direction of arrow IV of FIG. 1.

In order to take out pills 4, the user pulls the assembly as illustrated in FIGS. 1 and 4, with the lid 5 pointing downward. The pills 4 then fall into the hopper 9 until they stop against the rear edge of the chimney 11 which prevents their flow through the discharge opening 12. The chimney 11 is still in reset position laterally off-centered within the tube 3. The user then pushes the lid 5 fully over the tube 3 which causes the boss 6 to penetrate into the front opening of the chimney 11. The taper of the boss 6 operates in the same fashion as a cam, which brings the chimney 11 approximately over the geometric axis 21 common to the tube 3, the discharge opening 12 and the boss 6. The pills 4 then drop inside the chimney 11 until they come in contact with the cross-pin or stop 17 which then stops them, since in this position the cross-pin projects into the chimney 11. The lateral displacement of the chimney 11 is obtained by compression of the elastic return blade 19.

Figure 3:
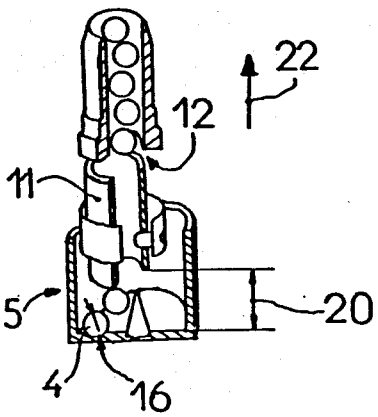

The operator then slightly pulls the tube 3 upward in the direction of arrow 22 in FIG. 3 with reference to the lid 5 and the following ensues.

The boss 6 clears the chimney 11 to create the clearance 20; the chimney 11 is free to move laterally under the action of the elastic return blade 19 which elastically brings the chimney back to its reset position, plugging the discharge opening 12. The internal space of the chimney 11 now clear of the cross-pin or stop 17 permits the pills 4 contained therein to fall into the area of the clearance 20 of the lid 5. The operator then only has to lift the tube 3 and its dispenser 1 above the lid 5 to permit access to the lid 5 containing the desired number of pills 4. It should be noted that the pills 4 taken from the tube are in the exact desired number; the operation was performed without any risk of contamination of the pills 4 through contact with hands; and the operation is very simple and fool-proof.

Of course, the desired number of pills 4 may be selected as required. This number is selected by setting the position of the cross-pin 17 inside the cylindrical skirt 10. The setting is obtained by using the ring 18 to move the cross-pin 17 in the axial slot 13 toward one or another lateral notches 14 where it is locked.

It is easy to see from the position of the cross-pin 17 illustrated in FIG. 2, that two pills 4 will be admitted upon each operation into the chimney 11. If the cross-pin 17 is placed in the next lower notch 14, as shown in FIG. 18, three pills 4 would be admitted to the chimney 11 each time. Using four notches 14 for instance, the user may then elect to take the pills 4 one at a time, two at a time, three at a time or four at a time.

Figure 9:
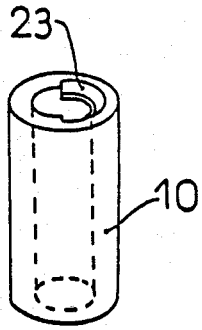
FIG. 9 illustrates a possible variation for the body of the dispenser.
Figure 10:
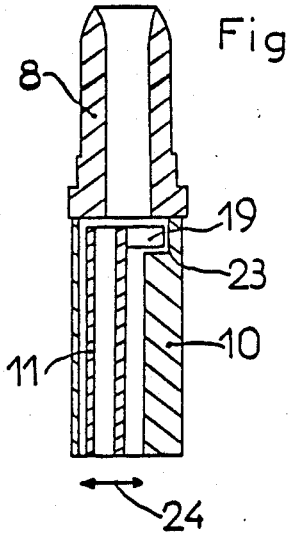
Figure 12:
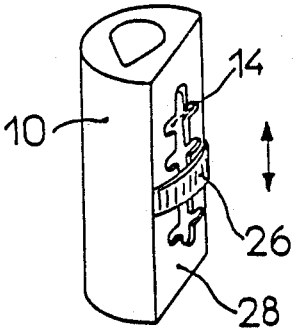

In the embodiment illustrated in FIGS. 9 through 11, the top of the skirt 10 includes a recessed curvature 23 designed to receive the respective end of the elastic return blade 19.

The elastic return blade 19 is built into the chimney 11 and may be made of any suitable material, plastic for instance. The assembly is obtained by engaging the chimney 11 in the skirt 10 and by slightly snapping the elastic return blade 19 in the recessed curvature 23. The elastic return blade 19 serves the dual function of constantly positioning the chimney 11 in the axial direction and it also permits the chimney to travel laterally inside the skirt 10 in the direction of arrow 24 when, acting as a return spring, it returns the chimney back to the position illustrated in FIGS. 1, 3, 4, 6, 7 and 11.

The embodiment depicted in FIGS. 12 through 15 illustrates another possible construction for setting the position of the cross-pin or fixed stop. In this case, the cross-pin 17 is made in one piece and includes a small crossbar 25 capable of locking itself in either one of the notches 14. A convex external control key 26 which can be elastically deformed by pressing it in the direction of arrow 27 in FIG. 15, against an axial flat surface 28, is also provided on the skirt 10 around the slot and notches 14.

After selecting the proper notch 14 for the number of pills 4 desired, release of the control key 26, illustrated in FIG. 14, keeps the small crossbar 25 and the stop pin 17 in the desired position.

In the embodiment illustrated in FIGS. 16 through 23, the chimney 11 still includes an axial slot 28*a*. However, the slot no longer has notches. The elastic return blade 19 connects the back of the chimney 11 with a skirt 29 extending around a body of the tube 3. However, the skirt 29 now has the shape of a regular polygon, a square for example. The same applies to a lid 32 which is adapted to be placed over the skirt 29. A reference mark 31 is provided on the outer surface of the tube 3 and the outer face of the lid 32 includes reference marks 33, 34, 35, etc. which can be aligned with the reference mark 31 by turning the lid 32 over the skirt 29, (Arrow 36, FIG. 21). It is thus possible to select the delivery of one, two, three or four pills with a single push of the lid 32 over the skirt 29.

As in the previous case, the internal face of the bottom 7 of the lid 32 includes a boss 38. In this case however, the boss 38 has the shape of a semi-truncated cone limited on either side by a diametral plane 37. Furthermore, bosses 39, 40, etc. are distributed around the boss 38, one for each of three faces of the polygonal lid 32. If it is square as illustrated in the drawings, three bosses 39, 40, and 41 should be provided and the face directed toward the diametral plane 37 should remain clear. Finally, it should be noted that the bosses 39 through 41 have variable heights 42, 43 as depicted in FIG. 20, with the heights being equal to multiples of the diameter 16 of each pill 4.

The device operates as follows.

Let us assume that the total height of the chimney 11 is equal to three times the diameter 16 of the pills 4. If the user pushes the lid 32 over the skirt 29 so that the slot 28*a* faces the boss 40 whose height 43 is equal to the diameter 16 of a pill 4, as the bottom of the chimney 11 comes in contact with the boss 38, the chimney 11 is displaced laterally toward the boss 40 which penetrates it through the slot 28*a*. Therefore, the chimney 11 comes to coincide with the offcentered outlet 44 of the hopper 9 (FIG. 22) and the pills fall therein until they come to rest on the top of the boss 40. In this case, two pills only would be admitted in the chimney 11 (FIG. 22) and then retrieved in the lid 32 (FIG. 23), since the height of the third pill was occupied by the boss 40.

It will be apparent that if the lid 32 had been pushed in using another reference mark 33, 34, 35 facing the reference mark 31, a boss 39 or 41, of a different height, would have penetrated the chimney 11. The lid 32 would then have received a different number of pills 4, one or three for instance.

It is understood that if the chimney 11 faces the diametral plane 37 of the boss 38 (as in FIG. 19), the pressure applied to the lid 32 would not cause any displacement of the chimney 11. This is the transportation position of the container in which the pills 4 cannot fall into the lid 32.

Practically, the presence of the flat face or diametral plane 37 is important. Indeed, during all filling operations, the chimney 11 remains in reset position of FIG. 19. In other words the elastic return blade 19 remains in reset position, without any bending stress during long storage. It is, therefore, protected against any permanent deformation and may be made of an economical plastic material.

The above constitutes a detailed description of the best mode contemplated for carrying out the present invention. It will be apparent to those skilled in the art that variations and modifications may be made from the above described embodiments without departing from the spirit of the present invention. Such variations and modifications are included within the intended scope of the claims appended hereto.

What is claimed is:

1. A dispenser for facilitating removal of generally spherical objects stored in a conventional tubular container, said dispenser comprising:

a body member axially aligned with said tubular container for cooperation therewith. said body member defining a fixed hopper adapted to receive said generally spherical objects from said tubular container:

a longitudinal tubular chimney having a slot cut therein adjacent said body member, said longitudinal tubular chimney having one end and being positioned normally offset a predetermined distance from said fixed hopper of said body member, said fixed hopper selectively cooperating with said longitudinal tubular chimney to selectively permit conveyance of a predetermined number of spherical objects thereinto:

a removable cover member mounted for relative movement with respect to said tubular container, said removable cover member being adapied io sealingly engage said tubular container to contain said longitudinal tubular chimney and said body member therein; said removeable cover member having a clearance space for receiving said spherical objects;

means for displacing said longitudinal tubular chimney, said means for displacing being integral with said removable cover member, said means for displacing laterally displacing said longitudinal tubular chimney into axial alignment with said fixed hopper when a predetermined pressure is applied to said removable cover member such as to permit conveyance of said predetermined number of spherical objects into said longitudinal tubular chimney;

means for regulating said predetermined number of spherical objects in said longitudinal tubular chimney, said means for regulating being spaced a predetermined distance from said one end of said longitudinal tubular chimney, said means for regulating cooperating wiih said longitudinal tubular chimney to selectively regulate said predetermined number of spherical objects conveyed into said longitudinal tubular chimney when said longitudinal tubular chimney is in alignment with said fixed hopper: and means for biasing said longitudinal tubular chimney, said means for biasing being juxtaposed said longitudinal tubular chimney and cooperating with said longitudinal tubular chimney to return said longitudinal tubular chimney to said normally offset position relative to said fixed hopper;

whereby said predetermined number of spherical objects conveyed into said longitudinal tubular chimney pass into said clearance space in said removable cover member as said means for biasing biases said longitudinal tubular chimney to said normally offset position when said predetermined pressure applied to said removable cover member is removed therefrom.

2. The dispenser according to claim 1 wherein said means for regulating further comprises:

a skirt interposed said tubular container and said removable cover member, said skirt substantially surrounding said longitudinal tubular chimney;

a plurality of notches formed in said skirt. said plurality of notches defining an axial slot therein, said plurality of notches being equidistantly spaced apart; and an annularly-shaped member slidably mounted external to said skirt, annularly-shaped said member rigidly mounting an inwardly projecting stop member on one end thereof for selective communication with one of said plurality of notches formed in said skirt;

whereby when said predetermined pressure is applied to said removable cover member such that said longitudinal tubular chimney is displaced into axial alignment with said fixed hopper, said stop member projects through said axial slot of said skirt into said longitudinal tubular chimney and regulates said predetermined number of spherical objects conveyed thereinto.

3. The dispenser according to claim 1 wherein said means for regulating further comprises:

a skirt interposed said tubular container and said removable cover member, said skirt substantially surrounding said longitudinal tubular chimney, said skirt further comprising a planar chordal segment;

a plurality of notches formed 1n said planar chordal segment defining an axial slot therein. said plurality of notches being equidistantly spaced apart; and a convexly-shaped deformable member mounted external to said skirt, said convexly-shaped deformable member being deformable against said chordal segment portion, said convexly-shaped deformable member further comprising a crosspin member integral therewith, said crosspin member being selectively positionable in one of said plurality of notches:

whereby when said predetermined pressure is applied to said removable cover member such that said longitudinal tubular chimney is displaced into axial alignment with said fixed hopper, said crosspin member projects through said axial slot of said chordal segment portion into said longitudinal tubular chimney and regulates said predetermined number of spherical objects thereinto.

4. The dispenser according to claim 1 wherein said means for regulating further comprises:

a plurality of upstanding projections, said plurality of upstanding projections being integrally mounted in said removable cover member, one of said plurality of upstanding projections selectively communicating with said longitudinal tubular chimney when said predetermined pressure is applied to said removable cover member to regulate said predetermined number of spherical objects conveyed thereinto.

5. The dispenser according to claim 4 wherein each of said plurality of upstanding projections has a first end and a second end, said first end being disposed in said longitudinal tubular chimney when said one of said plurality of upstanding projections is selectively communicating therewith to regulate said predetermined number of spherical objects being conveyed into said longitudinal tubular chimney. said second end being integrally mounted to said removable cover member.

6. The dispenser according to claim 4 wherein each one of said plurality of upstanding projections projects upwardly a predetermined distance from said second end, to said first end said predetermined distance successively increasing by a multiple corresponding to the external diameter of one of said predetermined number of generally spherical objects such that said predetermined number of spherical objects being conveyed into said longitudinal tubular chimney may be preselected.

7. The dispenser according to claim 4 wherein said removable cover member further comprises a plurality of indication members externally located thereon, each of said plurality of indication members corresponding to a respective one of said plurality of upstanding projections and being indicative of said predetermined distance each said upstanding projection projects upwardly into said longitudinal tubular chimney.

8. The dispenser according to claim 7 wherein said tubular container further comprises a reference mark of the external surface thereof, said reference mark being selectively alignable with one of said plurality of indication members to permit selection of said predetermined number of spherical objects to be conveyed into said longitudinal tubular chimney.

9. The dispenser according to claim 4 wherein said means for displacing said longitudinal tubular chimney further comprises a boss centrally located in the removable cover member, said boss generally being configured in the shape of a semi-truncated cone having a diametral plane on one side thereof, said diametral plane being adapted to maintain said longitudinal tubular chimney in said normally offset position relative to said fixed hopper.

10. The dispenser according to claim 15 wherein said skirt comprises a recessed portion, said recessed portion being adapted to recaive said means for biasing therein.

11. The dispenser according to claim 10 wherein said means for biasing are integrally mounted with said longitudinal tubular chimney.

* * * * *

UNITED STATES PATENT AND TRADEMARK OFFICE

CERTIFICATE OF CORRECTION

PATENT NO. : 4,848,593

DATED : July 18, 1989

INVENTOR(S) : Jean-Claude Jeandaud

It is certified that error appears in the above-identified patent and that said Letters Patent is hereby corrected as shown below:

Column 1, line 4, delete "HOMOEPATHIC" and insert ---- HOMEOPATHIC ----.

Column 1, line 12,delete "drugs" and insert ---- drug ----.

Column 1, line 20, delete "Thsi" and insert ---- This ----.

Column 1, line 56, delete "offcentered" and insert ---- off centered ----.

Column 5, line 11, before "reset" insert ---- the ----.

Column 5, line 30, delete "." and insert ---- , ----.

Column 5, line 33, delete ":" and insert ---- ; ----.

Column 5, line 42, delete ":" and insert ---- ; ----.

Column 5, line 45, delete "adapied io" and insert ---- adapted to ----.

Column 5, line 48, delete "removeable" and insert ---- removable ----.

UNITED STATES PATENT AND TRADEMARK OFFICE

CERTIFICATE OF CORRECTION

PATENT NO. : 4,848,593

DATED : July 18, 1989

INVENTOR(S) : Jean-Claude Jeandaud

It is certified that error appears in the above-identified patent and that said Letters Patent is hereby corrected as shown below:

Column 5, line 66, delete "wiih" and insert ---- with ----.

Column 6, line 3, delete ":" and insert ---- ; ----.

Column 6, line 29, delete "annularly-shaped said" and insert ---- said annularly-shaped ----.

Column 6, line 49, delete "1n" and insert ---- in ----.

Column 6, line 59, delete ":" and insert ---- ; ----.

Column 6, line 64, delete in its entirety.

Column 6, line 65, before "projects" insert ---- member ----.

Column 6, line 68, before "thereinto" insert ---- conveyed ----.

Column 7, line 20, delete "." and insert ---- , ----.

Column 7, line 24, delete "end, to said first end" and insert ---- end to said first end, ----.

UNITED STATES PATENT AND TRADEMARK OFFICE

CERTIFICATE OF CORRECTION

PATENT NO. : 4,848,593

DATED : July 18, 1989

INVENTOR(S) : Jean-Claude Jeandaud

It is certified that error appears in the above-identified patent and that said Letters Patent is hereby corrected as shown below:

Column 8, line 10, delete "of" and insert ---- on ----.

Column 8, line 18, delete "the" and insert ---- said ----.

Column 8, line 25, delete "15" and insert ---- 2 ----.

Column 8, line 27, delete "recaive" and insert ---- receive ----.

Signed and Sealed this

First Day of January, 1991

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,848,593

DATED : July 18, 1989

INVENTOR(S) : Jean-Claude Jeandaud

It is certified that error appears in the above-identified patent and that said Letters Patent is hereby corrected as shown below:

TITLE PAGE:

Assignee should be shown as "Pharmacologie Homeopathique Dolisos - Laboratories Jean Tetau". Paris, France.

Signed and Sealed this

Fourth Day of June, 1991

*Attest:*

HARRY F. MANBECK, JR.

*Attesting Officer*

*Commissioner of Patents and Trademarks*